US006216674B1

(12) United States Patent
Corkill

(10) Patent No.: US 6,216,674 B1
(45) Date of Patent: Apr. 17, 2001

(54) FUEL SYSTEM VAPOR INTEGRITY TESTING WITH TEMPERATURE COMPENSATION

(75) Inventor: William John Corkill, Leics (GB)

(73) Assignee: Jaguar Cars Limited, Coventry (GB)

( * ) Notice: Subject to any disclaimer, the term of this patent is extended or adjusted under 35 U.S.C. 154(b) by 0 days.

(21) Appl. No.: 09/510,985

(22) Filed: Feb. 22, 2000

(51) Int. Cl.[7] ..... F02M 33/04

(52) U.S. Cl. ..... 123/520

(58) Field of Search ..... 123/516, 518, 123/519, 520, 198 D, 119 A, 118.1

(56) References Cited

U.S. PATENT DOCUMENTS 5,243,944 * 9/1993 Blumenstock ..... 123/520
5,251,592 * 10/1993 Seki et al. ..... 123/520
5,765,539 * 6/1998 Isobe et al. ..... 123/520

* cited by examiner

*Primary Examiner*—Thomas N. Moulis
(74) *Attorney, Agent, or Firm*—Jerome R. Drouillard

(57) ABSTRACT

A vehicle fuel system has on-board diagnostics for leak testing with correction for different temperature variations arising in an evacuation phase. Pressure is measured at intervals during the evacuation phase and a correction is made to the loss of vapor integrity indication based on the values and timing of the pressure measurements made during the evacuation phase.

8 Claims, 2 Drawing Sheets

FUEL SYSTEM VAPOR INTEGRITY TESTING WITH TEMPERATURE COMPENSATION

FIELD OF THE INVENTION

This invention relates to a vehicle fuel system with on-board diagnostics for vapor integrity testing.

BACKGROUND OF THE INVENTION

Vehicle fuel systems are required to control emission of fuel vapor. This is done by collecting vapor emitted from the fuel tank in a purge canister containing carbon to absorb the vapor. The canister is purged of collected vapor when the engine is running by drawing air through the canister into the engine, relying on manifold vacuum. The system is sealed except for venting to the atmosphere via the purge canister. On-board vapor integrity testing is required to a warning is given if vapor loss from the sealed system exceeds predetermined levels. Typical known vapor integrity testing systems are described U.S. Pat. Nos. 5,333,590 and 5,765,121.

The latter patent describes a basic test in which the manifold vacuum is used to pump out the fuel tank and the return of tank pressure to atmospheric ("bleedup") is monitored. If bleedup exceeds a certain threshold value R the system is determined to have an unacceptable vapor integrity. If the bleedup is less than R, it assumed that vapor integrity is acceptable. Low level loss of vapor integrity cannot be reliably detected with this basic system because vapor generation from fuel in the tank can cause pressure in the evacuated system to recover more rapidly than air ingress due to a low level loss of vapor integrity.

In addition, the bleedup for a particular level of vapor integrity depends on vapor volume, that is the volume of free space above the fuel tank and in the purge canister and connecting passages. Vapor volume is itself directly related to fuel level.

Thus, in order to improve the sensitivity of the basic bleedup test, measures must be taken to correct for different operating conditions, particularly the fuel level and the rate of vapor generation in the tank.

For example, U.S. Pat. No. 5,333,590 uses a threshold value R which is not fixed but is related to vapor volume and fuel temperature.

It is also known to improve the sensitivity of vapor integrity testing by using a two stage test. The first stage is a bleedup test in which pressure increase over a certain period (period_A) is measured. A second stage is carried out in which pressure rise of the closed system from atmospheric over a second period (period_B) is monitored. The second stage gives an indication of vapor generation in the tank under prevailing conditions. A constant scaling factor is used to deduct a proportion of pressure rise found during the second stage to provide a value which more closely represents the level of bleedup due to air ingress into the tank during the first stage of the test.

A source of error that is not dealt with in the existing systems described above arises from variations in temperature of the gaseous contents of the tank at the start of bleedup, due in the main to variations in the evacuation. Evacuation results in the temperature of the vapor contents being reduced below ambient temperature by an amount which depends on the nature of the evacuation (fast, slow, early or late). Without any compensation for such temperature variation, a worst case error in may be equivalent to a hole diameter of around 0.5 mm. Errors of this magnitude are not acceptable when small leaks equivalent to 0.5 mm diameter hole are required to be detected.

SUMMARY OF THE INVENTION

According to the present invention a vehicle fuel system with on-board diagnostics for vapor integrity testing comprises:

a) a fuel tank for containing fuel for delivery to an internal combustion engine;

b) a purge canister connected to the space in the tank above the fuel;

c) a canister vent valve (CVV) for connecting the purge canister to the atmosphere;

d) a purge valve for connecting the purge canister to the engine; and e) an electronic control unit (ECU) arranged for monitoring pressure and fuel level in the tank and other engine, vehicle and ambient conditions and for controlling opening and closing of the valves;

f) the CVV and the purge valve being controlled by the ECU for venting the tank to atmosphere via the purge canister (purge valve closed, CVV open), and for purging vapor from the canister by allowing air to be drawn through the canister by manifold vacuum (both valves open);

g) the ECU being arranged to carry out a periodic vapor integrity test, when the engine is running;

h) the vapor integrity test including:

i) evacuation of the tank with the purge valve open and the CVW closed (evacuation phase);

ii) monitoring pressure rise in the tank with both valves closed (bleedup phase); and iii) developing an indication of vapor integrity from time and pressure values measured during the bleedup;

in which:

pressure in the tank is measured at intervals during the evacuation phase and a correction is made to the vapor integrity indication based on the values and timing of the pressure measurements made during the evacuation phase, the correction being effective to reduce errors in the vapor integrity indication due to temperature variations in the air/vapor in the tank at the commencement of bleedup due to variations in the evacuation phase.

The improved fuel system test contemplated by the invention is preferably implemented using the vehicle's existing electronic engine control unit and the fuel system pressure sensor which is used for other purposes. As a consequence, the benefits of the invention may be obtained at very little additional cost.

These and other features and advantages of the present invention may be better understood by considering the following detailed description of a preferred embodiment of the invention.

During the course of this description, frequent reference will be made to the attached drawings.

DESCRIPTION OF THE PREFERRED EMBODIMENT

Figure 1:
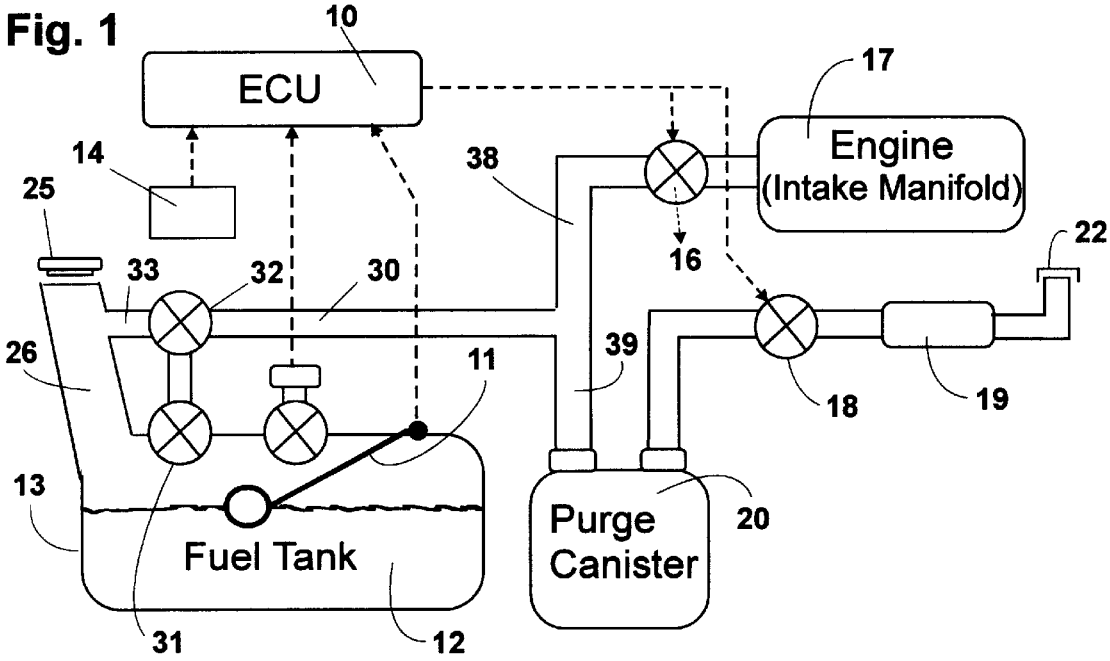
FIG. 1 is a schematic diagram of a vehicle fuel system with on-board diagnostics for vapor integrity testing which utilizes the principles of the invention.

A two stage diagnostic procedure for vapor integrity testing is performed automatically at predetermined intervals by an electronic control unit (ECU) 10 seen in FIG. 1. The test is aborted if prevailing conditions (fuel sloshing, heavy acceleration etc) are such that a reliable test result cannot be expected.

The ECU 10 is connected to a fuel sender 11 for sensing the level of fuel 12 in a fuel tank 13, an ambient temperature transducer 14, and a fuel tank pressure transducer 15.

The ECU controls a vapor management valve (VMV) 16 and a normally open canister vent valve (CVV) 18. The CVV controls the air flow through a filtered passageway 19 which connects a purge canister 20 containing charcoal for absorbing fuel vapor to an atmospheric vent 22. The VMV 16, when open, connects the purge canister 20 to the intake manifold 17 of the vehicle engine via lines 38 and 39.

The closed fuel system seen in FIG. 1 further includes a vacuum/pressure relief valve within a cap 25 which closes the fuel inlet passageway 26 of the fuel tank 13. A passageway 30 extends from a rollover valve 31 at the top of the tank 13 to both the purge canister 20 and the VMV 16. A running-loss vapor control valve 32 connects the passageway 30 to the upper portion of the fuel inlet passageway 26 via a branch passageway 33.

When the vehicle engine in not running the ECU closes the VMV 16 and opens the CVw 18 so that fuel vapor is absorbed by carbon in the purge canister before reaching the atmosphere. Moreover, air may enter the fuel system via the purge canister 20 if pressure in the tank falls below atmospheric due to condensation of vapor. When the engine is running, the ECU from time to time opens both VMV 16 and CVV 18 so that air is drawn through the purge canister by manifold vacuum to purge fuel vapor from the canister.

Figure 2:
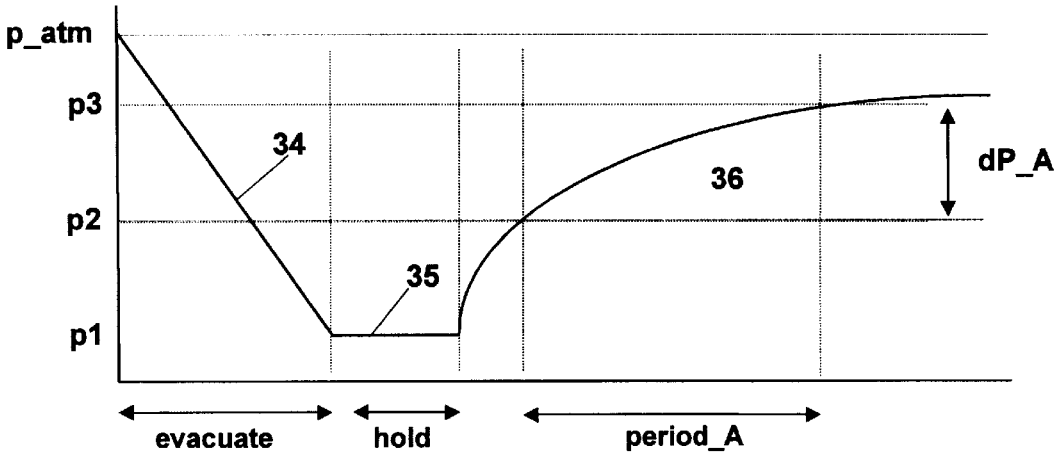
FIG. 2 is a graph of the pressure changes which take place in a first stage of the vapor integrity test carried out in the system shown in FIG. 1.

The diagnostic vapor integrity testing procedure takes place in two stages. In stage A the pressure changes in the tank 13 as measured by the pressure sensor 15 are illustrated in FIG. 2. During an evacuation phase 34 the ECU closes the CVV 18 and opens the VMV 16 so that air and vapor are pumped out of the tank 13 and canister 20 by manifold vacuum until a desired pressure p1 is achieved. The evacuation phase is followed by a holding stage 35 of several seconds. After the holding phase, the ECU closes both the VMV 16 and the CVV 18, sealing the system. The tank pressure as indicated by the pressure sensor 15 is monitored by the ECU during a bleedup phase 36. At the point in time that the tank pressure recovers to p2, the ECU starts counting out period_A, monitors the pressure p3 at the end of period_A and calculates and saves the pressure difference dP_A=p2−p3.

Figure 3:
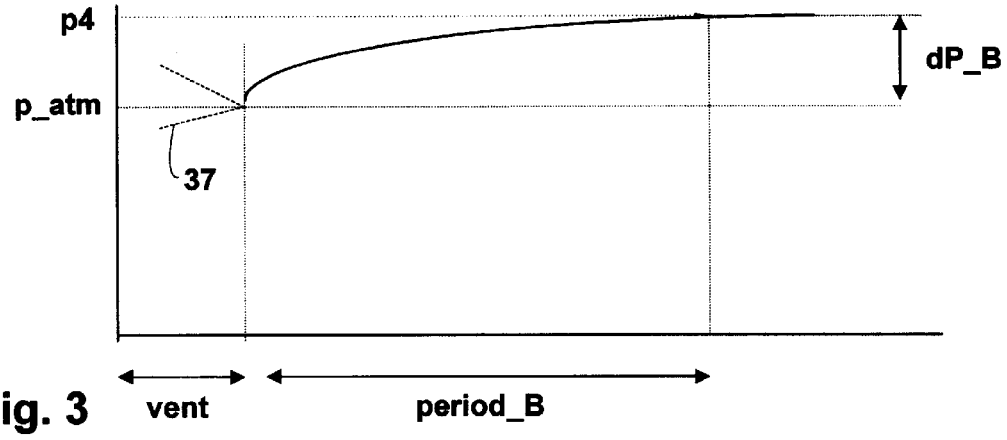
FIG. 3 is a graph of the pressure changes which take place in a second stage of the vapor integrity test carried out in the system shown in FIG. 1.

In stage B, which may take place before or after stage A, the pressure changes in the tank 13 are as illustrated in FIG. 3. After initial venting 37 to allow the pressure to go to atmospheric, the ECU closes both the CVV 18 and the VMV 16 and starts period_B. During period_B, the pressure will normally rise due to vapor generation, but may fall under certain conditions, for example if ambient conditions are such that vapor condenses in the tank. At end period_B, the ECU monitors the tank pressure p4 and calculates and saves the pressure increase above atmospheric dP_B=p4−p_atm.

The holding period is intended to allow conditions in the tank to approach a steady state and reduce variability due to the speed of evacuation (which is influenced by the level of manifold vacuum, in turn influenced by engine load and throttle position). In practice it is not feasible to have a sufficiently long holding period to avoid errors in the pressure measurements.

Accuracy of the results from the vapor integrity test strategy depends both on accurate measurement of those parameters for which sensors are provided (pressure, fuel tank volume etc) and on control of test conditions under which the test is carried out (15–85% tank volume limits, abort on high fuel slosh etc).

There are several factors which influence the test result but may be impossible to measure yet occur regularly under normal driving conditions. For example, driver input during evacuation and venting processes alters the gas properties and result in over- or under-estimation of the perceived leak size.

The primary effect of unpredictable inputs during evacuation is their influence on tank vapor temperature. A gas temperature sensor would enable discrimination between the effect on pressure of gas temperature and other factors such as vapor generation or a genuine loss of vapor integrity. A sensor, however, would require a relatively fast response (typically 1 sec) and would add to the system cost. It would also require its own diagnostics.

The present invention estimates corrections for the dynamic temperature changes from the measured pressure during evacuation.

The theory behind temperature compensation and the algorithms to enable it to be inferred from available pressure data are explained below.

Without any compensation the worst-case error is, typically, equivalent to a hole diameter of around 0.5 mm. Even a proportion of this error is significant for 1 mm detection. For 0.5 mm detection this factor alone amounts to a maximum of 100% noise and it is obviously important that this error is reduced.

To illustrate the concept of temperature error consider a sealed tank under ideal conditions—no vapor generation or loss of vapor integrity, and with tank and contents stabilized at the same temperature (T0). If the tank pressure is reduced rapidly by −2 kPa (this is a typical level of pressure reduction for the evacuation phase) then the temperature of the vapor contents will be reduced, by around 0.7 to 1.1° C. depending on the fuel vapor properties within the tank. If the tank is then sealed the temperature will rise towards its original value (T0), due to heat transfer between the gas and the surroundings, and the pressure also will rise accordingly (eventually by around 0.2 to 0.35 kPa). The effect applies whenever there is a pressure change, up or down, and influences both test stages irrespective of the order in which they are executed.

The pressure and temperature changes involved in the test are relatively small (e.g., +/−2%) and so the principal of superposition is assumed for the effects of the loss of vapor integrity and associated errors. Hence the transient temperature error described above may be superimposed on any pressure changes present, whether due to vapor or a genuine loss of vapor integrity. The net effect of these errors is to cause over-estimation of the size of any loss of vapor integrity (or to indicate a loss of vapor integrity when none is present).

It is possible to minimize the effects of thermal in-equilibrium by setting target values for evacuation and venting processes within the strategy and optimizing the strategy for these values. However, some uncertainties, or noise, will still exist and the errors cannot be completely eliminated by this method. By estimating the dynamic temperature its contribution to pressure can be estimated and the net pressure change due to other factors (loss of vapor integrity & vapor) can be identified. Such temperature compensation may used together with the techniques described in our co-pending U.S. patent applications Ser. Nos. xxx,xxx and yyy,yyy for improved discrimination between loss of vapor integrity and vapor.

The sources of test temperature variation and alternative ways of compensation are discussed below:

a) Primary Sources of Error

The test temperature(s) will be influenced by the following parameters i. evacuation duration ii. evacuation characteristics iii. holding time at the start of period_A iv. venting at the end of stage A (if stage B follows)

v. additional conditional procedures (re-evacuation etc)

For test repeatability it is clearly desirable to have target values for all of these. The most basic targets for evacuation would be a linear evacuation to a set depression in a target time, followed by holding phase of fixed duration at this depression prior to commencement of stage A. This desired or optimum evacuation characteristic is shown in FIG. 2. Ideally venting to atmosphere via the CCV (FIG. 3) would also be in a controlled manner.

In practice, driver input influences manifold pressure and both loss of vapor integrity and vapor generation affects the volume of gases that must be evacuated to achieve the desired pressure. These effects make it impossible to achieve both the target evacuation time and profile. Additional (conditional) phases introduce further deviations from the basic strategy.

b) Principle of Temperature Compensation

Non-achievement of target evacuation time and/or profile will introduce a noise equivalent to an unknown proportion of the 100% or so range referred to above. The use of a temperature model allows optimization for a target strategy with temperature compensation for deviations or, alternatively, the development of an absolute strategy using basic thermodynamics. Algorithms to assist these, together with simplifications for the former, are described here.

c) Analytical Algorithm for Temperature Compensation

The algorithm is based purely on the ratiometric temperature changes resulting from a pressure history, thus avoiding the need for any absolute reference temperature, either measured or inferred.

Over any time interval Δt the measured pressure P changes by ΔP. The gas temperature will be driven both by this pressure change and by heat transfer thus:

$$\Delta T = \frac{(\gamma_f - 1)}{\gamma_f} * T * \frac{\Delta P}{P} + \frac{(T0 - T) * \Delta t}{t_therm}$$

where:

P is measured tank pressure;

T0 is the estimated temperature at the start of the stage;

t_therm is the fuel tank-vapor thermal time constant; and $\gamma_f$=adiabatic index for fuel vapor.

Substituting non-dimensional factors Tr=T/T0 (T0 refers to start of test):

$$\Delta Tr = \frac{(\gamma_f - 1)}{\gamma_f} * \frac{\Delta P}{P} + \frac{(1 - Tr) * \Delta t}{t_therm}$$

Hence:

$$\frac{\Delta Tr}{\Delta t} = \frac{(\gamma_f - 1)}{\gamma_f P} * \frac{\Delta P}{\Delta t} + \frac{(1 - Tr)}{t_therm}$$

and Tr at any time is calculated by summing ΔTr/Δt from an initial condition Tr=1. It is assumed that digital processing will be used. In an analog system the dTr/dt would be integrated.

Application of Tr

The bulk of the tank vapor experiences a change in pressure and temperature due to volumetric compression caused by vapor formation together with leak flow $$\frac{\Delta V}{V} = \frac{\Delta p}{p} - \frac{\Delta T}{T} = \frac{\Delta p}{p} - \frac{\Delta T}{Tr}$$

Knowing ΔP, P & V by measurement and ΔTr and Tr from above the true volumetric flow can be calculated ΔV=incremental vapor generation plus leak flow Analysis can then separate the contribution due to vapor from that of leak flow without the residual error caused by the unknown temperature history.

d. Simplified Algorithms

The above calculation may be excessively time-consuming during evacuation in a real engine management system. Alternatively a first-order correction based on monitoring pressure during evacuation as described below may be used.

FIG. 2 shows a vapor integrity test evacuation and stage A bleedup an which optimum rate of evacuation 34 has been achieved followed by hold 35 at pressure pl and bleedup 36. Pressure difference dP_A will give a correct value for combined vapor generation and loss of vapor integrityage.

Figure 4:
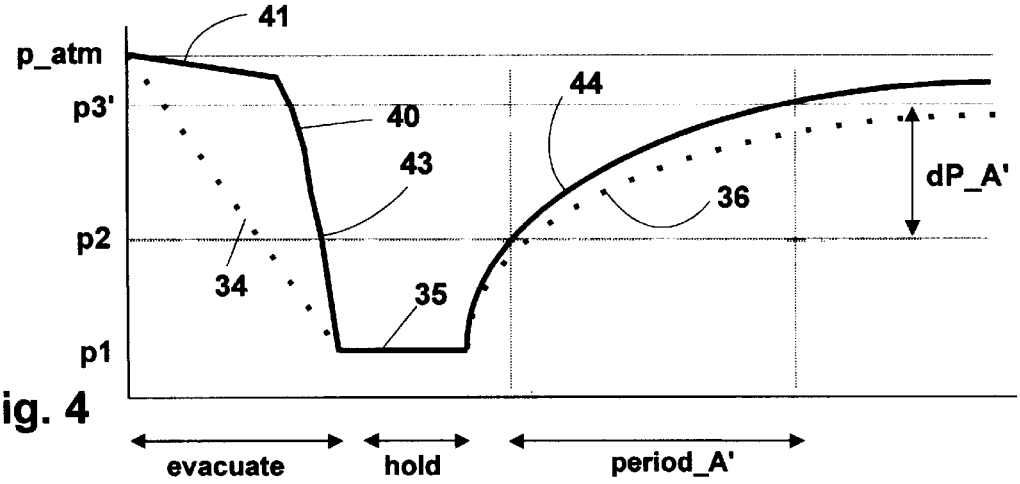
FIG. 4 is a graph of the pressure changes which take place in a first stage of the vapor integrity test carried out in the system shown in FIG. 1, illustrating the effect of an early slow or late rapid evacuation.
Figure 5:
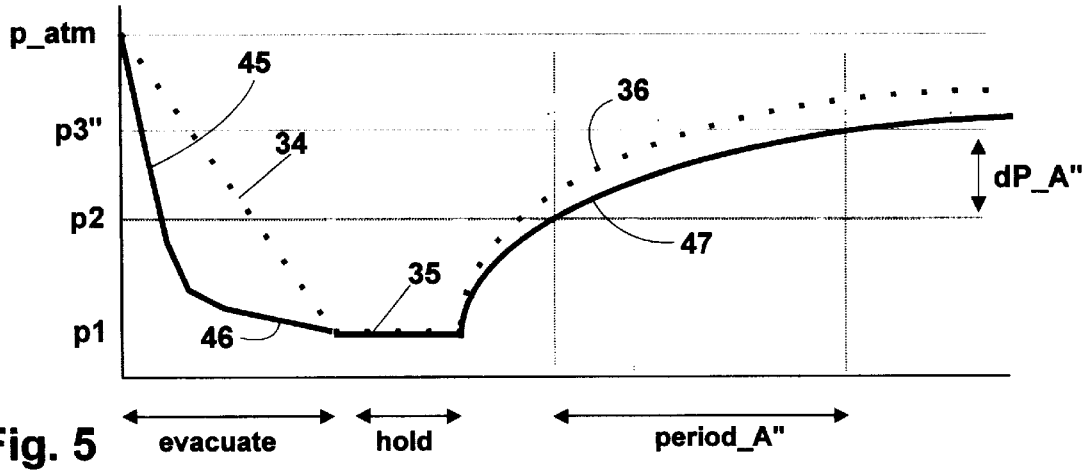
FIG. 5 is a graph of the pressure changes which take place in a first stage of the vapor integrity test carried out in the system shown in FIG. 1, illustrating the effect of an evacuation that results in the tank pressure being held at low pressure for a longer period.

The extremes of evacuation profiles compared to the optimum 34 are shown in FIGS. 4 and 5. In FIG. 4 a late rapid evacuation 40 to the target pressure p1 results in minimum settling time and hence has the lowest temperature at stage A commencement. This may occur if the test takes place at an initially low manifold depression 42 (acceleration) followed by a high manifold depression 43 (reduced throttle). Temperature recovery continues during bleedup 44 and contributes to a more rapid rise in pressure than for the test shown in FIG. 2 (for comparison the FIG. 2 test pressure variations are shown in dotted lines in FIGS. 4 and 5). The more rapid rise in pressure compared to FIG. 2 gives a greater increase in pressure over the period_A' than over the period_A FIG. 2. The measured pressure change dP_A' is greater than dP_A, and absent temperature compensation, this would result in an over estimation of hole size.

FIG. 5 shows another extreme case. A rapid initial but incomplete evacuation 45 is followed by a slow evacuation 46 down to pressure p1. This results in the maximum settling time at or near pressure p1 prior to stage A commencement. The temperature at the start of bleedup 47 is a higher temperature than for the optimum test of FIG. 2. The measured pressure change dP_A" is less than dP_A and hole size, without temperature compensation will be underestimated.

According to a preferred embodiment of the invention, the evacuation profiles is characterized by integrating, or summing, the measured depression during evacuation and dividing it by both the target depression and the target time.

$$\text{Temperature_Error_Indicator}=^{\Sigma P\Delta t}/(\text{p_atm}-\text{p1})*\text{T_evac}$$

The resultant value (within the range 0 to 1) is used to generate a correction to the following stage pressure rise. The target straight-line characteristic 34 gives a value of 0.5 and zero temperature correction. The corrections to dP_A for other values of the summation are bidirectional around zero as shown in the following table. The FIG. 4 characteristic gives a summation value of about 0.8 and the FIG. 5 characteristic gives a value of about 0.2.

| Value of Temperature Error Indicator | Correction Applied to dP_A |
|---|---|
| 0.1 | +0.15 |
| 0.2 | +0.11 |
| 0.3 | +0.07 |
| 0.4 | +0.03 |
| 0.5 | 0 |
| 0.6 | −0.03 |
| 0.7 | −0.07 |
| 0.8 | −0.11 |
| 0.9 | −0.15 |

A similar algorithm can be applied to the effect of venting on stage B, if appropriate. Should stage A follow stage B then the algorithm would be adjusted accordingly to reflect the transition from a positive pressure at the end of stage B to the target depression prior to stage A.

It is to be understood that the embodiment of the invention described above is merely illustrative on one application of the principles of the invention. Numerous modifications may be made to the methods and apparatus described without departing from the true spirit and scope of the invention.

What is claimed is:

1. A vehicle fuel system with on-board diagnostics for leak testing comprising:

a) a fuel tank for containing fuel for delivery to an internal combustion engine;

b) a purge canister connected to the space in the tank above the fuel;

c) a canister vent valve (CVV) for connecting the purge canister to the atmosphere;

d) a purge valve for connecting the purge canister to the engine; and e) an electronic control unit (ECU) arranged for monitoring pressure and fuel level in the tank and other engine, vehicle and ambient conditions and for controlling opening and closing of the valves;

f) the CVV and the purge valve being controlled by the ECU for venting the tank to atmosphere via the purge canister (purge valve closed, CVW open), and for purging vapor from the canister by allowing air to be drawn through the canister by manifold vacuum (both valves open);

g) the ECU being arranged to carry out a periodic vapor integrity test, when the engine is running;

h) the vapor integrity test including:

i) evacuation of the tank with the purge valve open and the CVV closed (evacuation phase);

ii) monitoring pressure rise in the tank with both valves closed (bleedup phase); and iii) developing an indication of loss of vapor integrity from time and pressure values measured during the bleedup;

in which:

pressure in the tank is measured at intervals during the evacuation phase and a correction is made to the loss of vapor integrity indication based on the values and timing of the pressure measurements made during the evacuation phase, the correction being effective to reduce errors in the loss of vapor integrity indication due to temperature variations in the air/vapor in the tank at the commencement of bleedup due to variations in the evacuation phase.

2. A vehicle fuel system as claimed in claim 1 in which the pressure values are summed or integrated over the time period of the evacuation phase, and a value representative of the result of such summation or integration used in a calculation or look up to give a correction factor for pressure measured during the bleedup.

3. A vehicle fuel system as claimed in claim 1 in which a temperature correction is calculated from each pressure value measured during the evacuation phase using the previous temperature correction calculated using the previous pressure value, said temperature correction being used to establish a corrected loss of vapor integrity indication.

4. A vehicle fuel system as claimed in claim 1 in which pressure values measured during the evacuation phase are summed and divided by a target evacuation pressure and a target evacuation time to give a temperature correction indicator value and temperature correction is made from the temperature correction indicator value.

5. A method of vapor integrity testing for a vehicle fuel system including the following steps: A vehicle fuel system with on-board diagnostics for vapor integrity testing including:

i) evacuation of fuel system (evacuation phase);

ii) monitoring pressure rise in the system with valves closed (bleedup phase); and iii) developing an indication of loss of vapor integrity from pressure values measured during the bleedup;

iv) measuring pressure in the tank at intervals during the evacuation phase; and v) making a correction to the loss of vapor integrity indication based on the values and timing of the pressure measurements made during the evacuation phase, the correction being effective to reduce errors in the loss of vapor integrity indication due to temperature variations in the air/vapor in the tank at the commencement of bleedup due to variations in the evacuation phase.

6. A method of leak testing as claimed in claim 5 including summing or integrating the pressure values over the time period of the evacuation phase, and using a value representative of the result of such summation or integration in a calculation or look up to give a correction factor for pressure measured during the bleedup.

7. A method of leak testing as claimed in claim 5 including calculating a temperature correction from each pressure value measured during the evacuation phase using the previous temperature correction calculated using the previous pressure value, and using temperature correction to establish a corrected loss of vapor integrity indication.

8. A method of leak testing as claimed in claim 5 including summing pressure values measured during the evacuation phase, dividing the sum by a target evacuation pressure and a target evacuation time to give a temperature correction indicator value and making the temperature correction using temperature correction indicator value.

* * * * *